US007225928B1

(12) United States Patent
Enko

(10) Patent No.: US 7,225,928 B1
(45) Date of Patent: Jun. 5, 2007

(54) INFLATABLE PUZZLE STORAGE

(75) Inventor: Frederick A. Enko, Westfield, MA (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 11/424,457

(22) Filed: Jun. 15, 2006

Related U.S. Application Data

(62) Division of application No. 10/747,622, filed on Dec. 30, 2003, now Pat. No. 7,086,533.

(51) Int. Cl.
*A63F 9/00* (2006.01)
*B65D 85/672* (2006.01)

(52) U.S. Cl. ..... 206/579; 206/315.1; 273/309; 273/157 R

(58) Field of Classification Search ..... 206/315.1, 206/579; 383/3, 4; 428/95, 33; 273/157 R, 273/309
See application file for complete search history.

(56) References Cited

U.S. PATENT DOCUMENTS

| | | | | |
|---|---|---|---|---|
| 3,704,892 | A | 12/1972 | Moravick | |
| 4,505,424 | A | 3/1985 | Chappars | |
| 5,105,944 | A | 4/1992 | Ingalls | |
| 5,375,707 | A * | 12/1994 | Richer | 206/315.1 |
| 5,538,248 | A | 7/1996 | Shillito | |
| 5,642,883 | A | 7/1997 | Rioux | |
| 5,651,547 | A | 7/1997 | Rannelli | |
| 5,669,092 | A | 9/1997 | Lin | |
| D392,146 | S | 3/1998 | Gregg | |
| 6,364,116 | B1 | 4/2002 | Ng | |
| 2002/0163126 | A1 | 11/2002 | Caldwell | |

* cited by examiner

*Primary Examiner*—Mickey Yu
*Assistant Examiner*—Jerrold Johnson
(74) *Attorney, Agent, or Firm*—Fish & Richardson P.C.

(57) ABSTRACT

An inflatable puzzle storage device and method is provided. To this end, a puzzle is completely or partially assembled on a puzzle assembly mat. To store or transport the puzzle, the puzzle assembly mat and puzzle pieces thereon are wrapped around an inflated tube and secured, such that the puzzle pieces remain in place relative to each other.

6 Claims, 3 Drawing Sheets

INFLATABLE PUZZLE STORAGE

RELATED APPLICATIONS

This application is a Divisional of Ser. No. 10/747,622 filed Dec. 30, 2003, now U.S. Pat. No. 7,086,533

TECHNICAL FIELD

This description relates generally to storing puzzles.

BACKGROUND

Devices that store partially or completely assembled puzzles are known. In some such devices, a puzzle is partially or completely assembled on a puzzle assembly mat, which is then rolled around and secured to a rigid tube, so as to retain the puzzle pieces in place relative to each other for storage or travel.

SUMMARY

A puzzle storage device makes use of an inflatable tube to allow for more compact storage than a rigid tube. To this end, a puzzle assembly mat is spread and an inflatable tube is inflated. Next, a puzzle is partially or completely assembled on the puzzle assembly mat. To store or transport the puzzle, the puzzle assembly mat and puzzle pieces are wrapped around the inflated tube such that the puzzle pieces remain in place relative to each other. Finally, the resulting assembly is secured with a mechanism such as straps, hook-and-loop fasteners, a bag, a zipper, or elastic loops. When not in use, the mat and tube can be folded for compact storage.

The details of one or more implementations are set forth in the accompanying drawings and the description below. Other features will be apparent from the description and drawings, and from the claims.

DESCRIPTION OF DRAWINGS

Like reference symbols in the various drawings indicate like elements.

DETAILED DESCRIPTION

Figure 1:
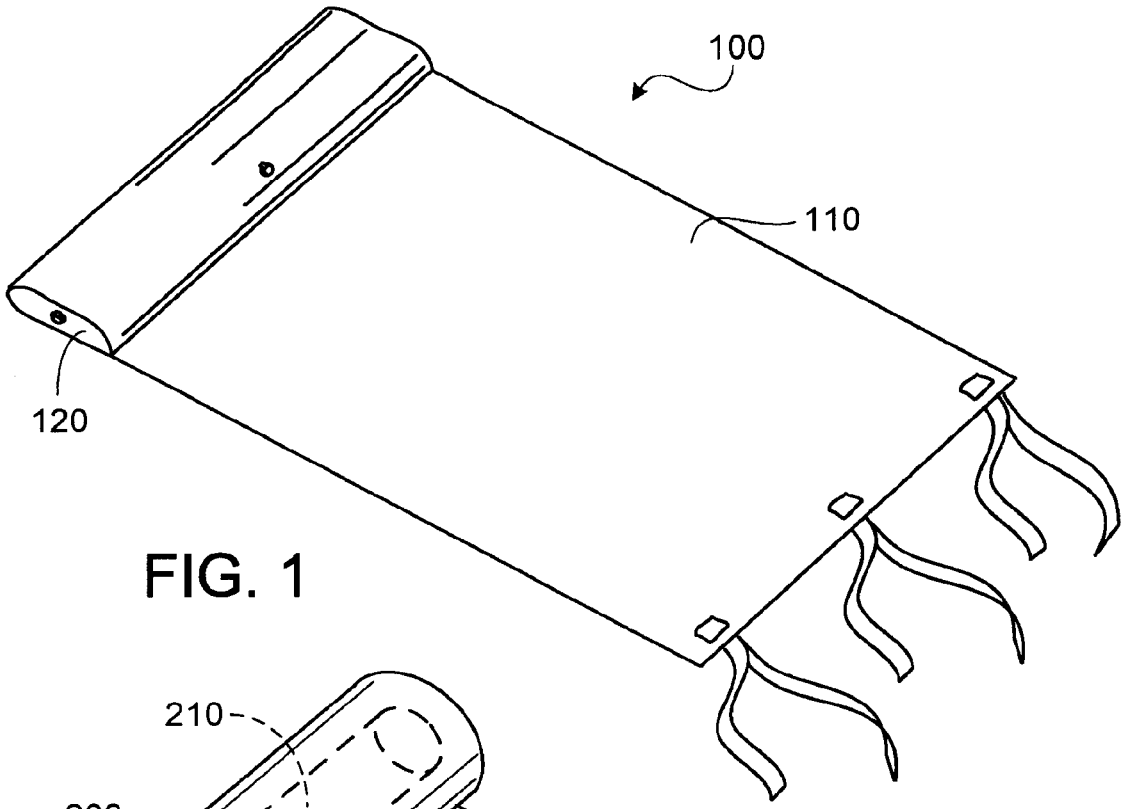
FIG. 1 is a perspective view of a puzzle storage device with a deflated tube.

Referring to FIG. 1, a puzzle storage device 100 includes a puzzle assembly mat 110 and an inflatable tube 120. The puzzle storage device 100 is made entirely of flexible materials that can be folded and rolled.

The puzzle assembly mat 110 is sized to accommodate the pieces of a partially or fully assembled puzzle. In one implementation, the mat 110 is approximately three feet wide and four feet long. The mat 110 is made from plastic or vinyl that provides strength and water resistance. The mat 110 includes a flocked side that is sufficiently rough to prevent puzzle pieces from sliding and a smooth side that is resistant to stains.

Figure 2:
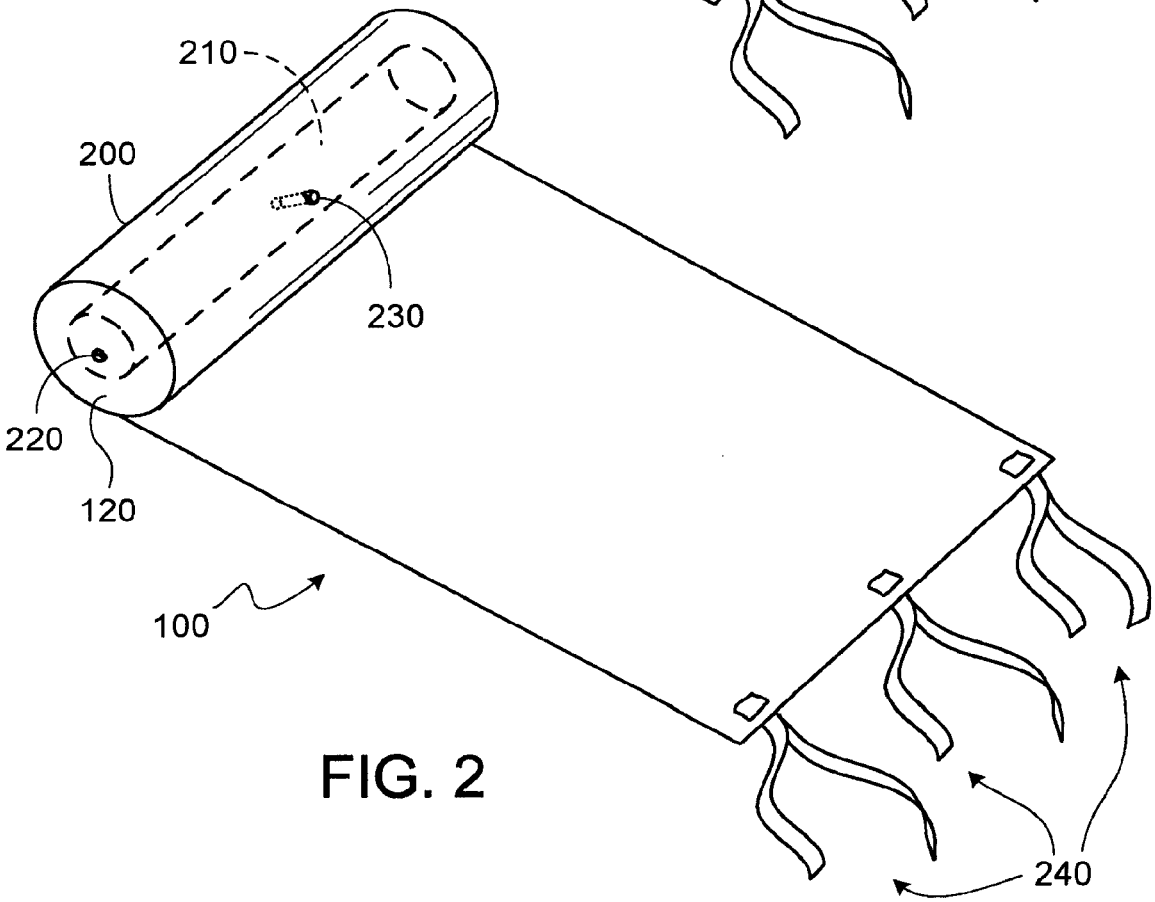
FIG. 2 is a perspective view of a puzzle storage device with an inflated tube.

Referring to FIG. 2, the inflatable tube 120 is divided into an outer inflation chamber 200 and an inner inflation chamber 210. The outer inflation chamber 200 is inflated by passing air through a nozzle 220 at the end of the tube 120 and the inner inflation chamber 210 is inflated by passing air through a nozzle 230 in the middle of the tube 120. Each of nozzles 220 and 230 are then sealed. The two inflation chambers 200 and 210 act as backups for each other such that a single puncture will not deflate the entire tube 120. In other implementations, the inflatable tube 120 may include only a single chamber or more than two chambers. When inflated, the inflatable tube 120 is cylindrical in shape and is about 6 inches in diameter. The inflatable tube 120 is attached to the puzzle assembly mat 110. In other implementations, the inflatable tube 120 may be detachable or detached from the puzzle assembly mat 110.

A securing mechanism 240 is used to keep the puzzle assembly mat 110 rolled around the inflatable tube 120 during storage or transport. Possible storage mechanisms include straps for tying, hook-and-loop fasteners, a bag, snaps, a zipper, or elastic loops. While the securing mechanism 240 is shown attached to the puzzle assembly mat 110, it may be detachable or detached from the mat 110. The securing mechanism 240 may be provided with the puzzle storage device 100, or by the user separately.

Figure 3A:
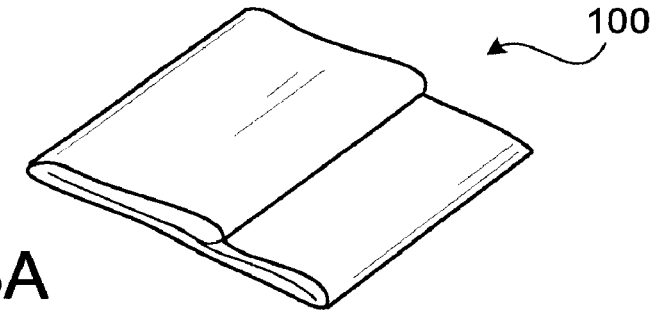
FIGS. 3A–3E are perspective views that illustrate use of the device of FIGS. 1 and 2.
Figure 3B:
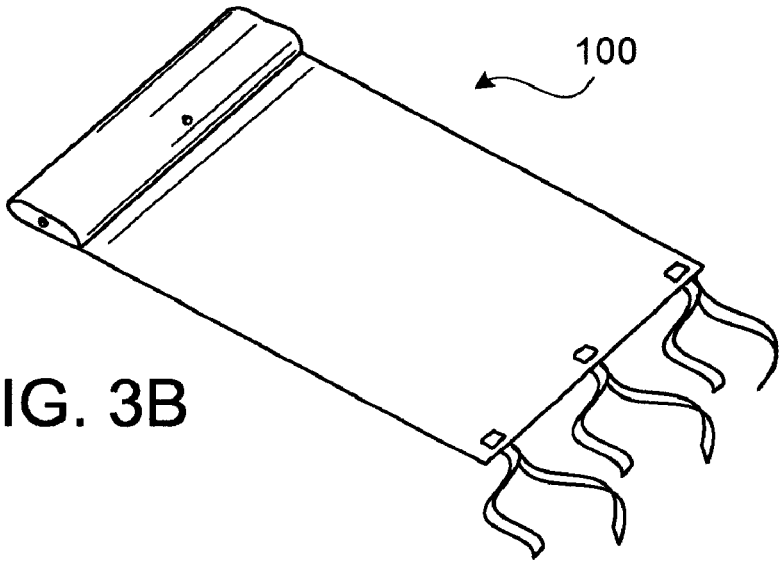
Figure 3C:
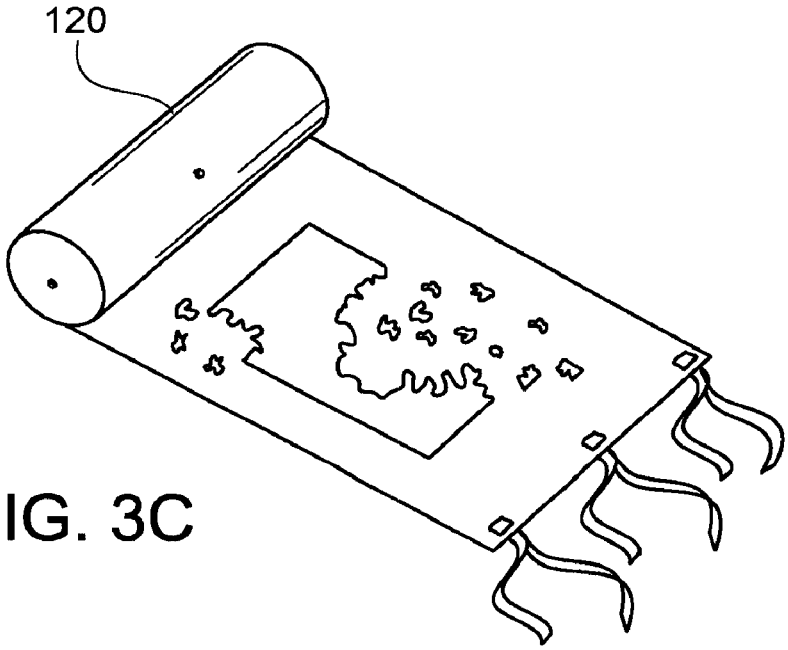
Figure 3D:
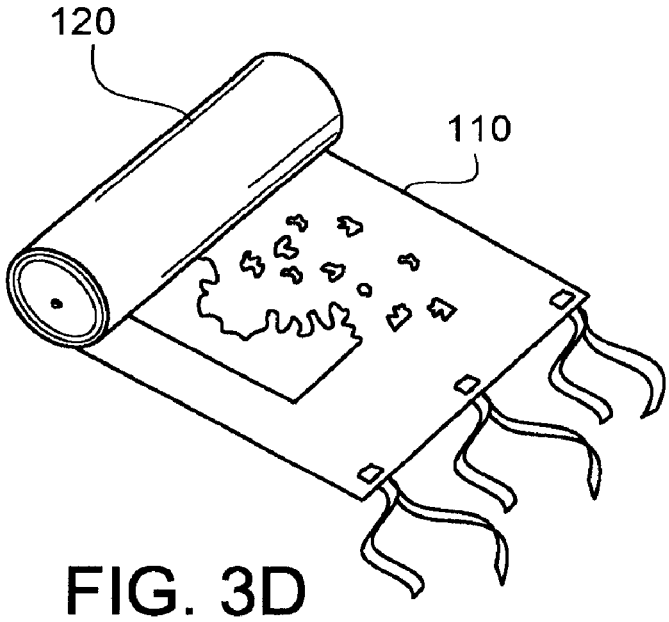
Figure 3E:
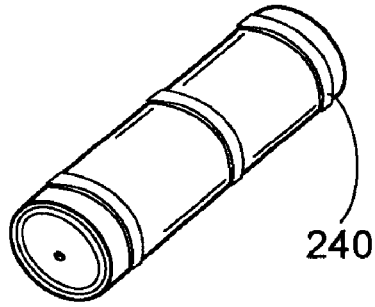
Figure 4:
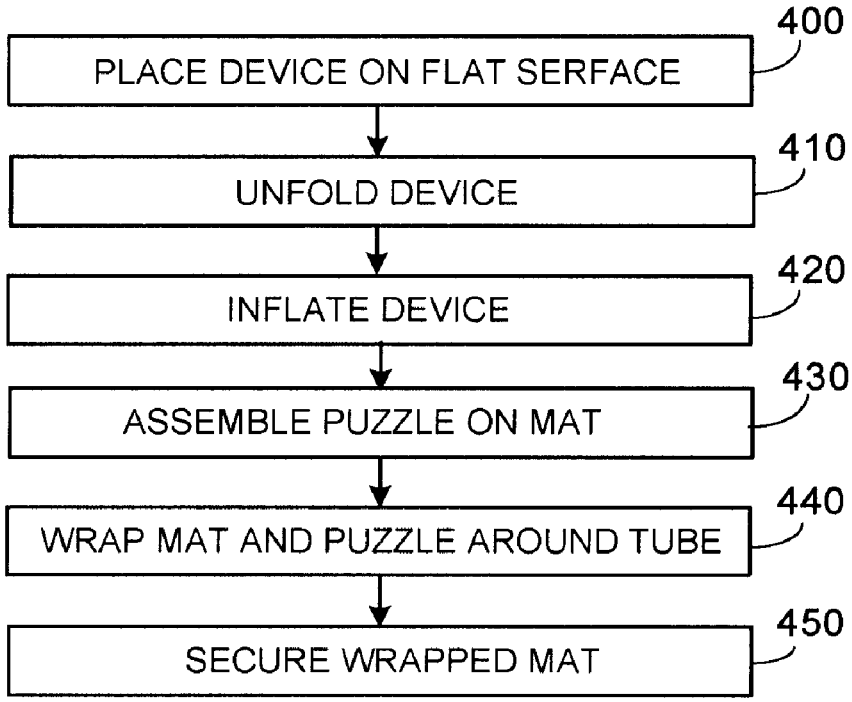
FIG. 4 is a flow chart that illustrates use of the device of FIGS. 1 and 2.

FIGS. 3A–3E and 4 illustrate the use of the puzzle storage device 100. First, the puzzle storage device 100, folded for compact storage before use, is placed on a flat surface (FIG. 3A, step 400). The puzzle storage device 100 is then unfolded and spread over the flat surface (FIG. 3B, step 410). Next, the inflatable tube 120 is inflated (step 420) and a puzzle is partially or completely assembled on the puzzle assembly mat 110 (FIG. 3C, step 430). In order to store the puzzle, the inflatable tube 120 is rolled over the puzzle assembly mat 110, thus wrapping the puzzle assembly mat 110 and puzzle pieces thereon around the inflatable tube 120 (FIG. 3D, step 440). A securing mechanism 240 is then used to secure the resulting roll; as shown, straps are tied (FIG. 3E, step 450). Once rolled, the puzzle pieces are kept in position relative to each other because they are held between the inflatable tube 120 and the rough surface of the puzzle assembly mat 110. The puzzle storage device is then ready for storage or transportation, and can later be unrolled in order to resume puzzle assembly or display.

A number of implementations have been described. Nevertheless, it will be understood that various modifications may be made. Accordingly, other implementations are within the scope of the following claims.

What is claimed is:

1. A method for storing a puzzle comprising:

placing puzzle pieces on a puzzle assembly mat individually or attached to other pieces; and rolling the puzzle assembly mat around an inflated tube such that the puzzle pieces remain in place relative to each other.

2. The puzzle storage method of claim 1, further comprising securing the rolled puzzle assembly mat to the inflated tube.

3. The puzzle storage method of claim 1, wherein the inflated tube is detachable from the puzzle assembly mat.

4. The puzzle storage method of claim 1, wherein a length of the inflated tube equals a width of the puzzle assembly mat.

5. The puzzle storage of claim 1, wherein the puzzle assembly mat has a rough surface.

6. The puzzle storage method of claim 1, wherein the inflated tube comprises a single inflation chamber.

* * * * *